US006338658B1

(12) United States Patent
Sweeney

(10) Patent No.: US 6,338,658 B1
(45) Date of Patent: Jan. 15, 2002

(54) SLOTTED ELECTRICAL CONNECTOR

(75) Inventor: Thomas M. Sweeney, Cincinnati, OH (US)

(73) Assignee: Ilsco Corporation, Cincinnati, OH (US)

( * ) Notice: Subject to any disclaimer, the term of this patent is extended or adjusted under 35 U.S.C. 154(b) by 0 days.

(21) Appl. No.: 09/504,340

(22) Filed: Feb. 14, 2000

(51) Int. Cl.[7] ..... H01R 4/36; H01R 9/22
(52) U.S. Cl. ..... 439/810; 439/709
(58) Field of Search ..... 439/810–814, 439/709; 339/272

(56) References Cited

U.S. PATENT DOCUMENTS

| | | | | | |
|---|---|---|---|---|---|
| 3,609,657 | A | * | 9/1971 | Stanback | 339/272 |
| 4,146,290 | A | | 3/1979 | Annas et al. | |
| 4,327,957 | A | * | 5/1982 | Cooper, Jr. et al. | 339/272 |
| 5,533,913 | A | * | 7/1996 | Boehm et al. | 439/810 |
| 5,957,733 | A | * | 9/1999 | Mello et al. | 439/814 |

OTHER PUBLICATIONS

Declaration of Thomas M. Sweeney with Exhibits A through G (29 pages).
CSA Standard C22.2 No. 65–93—Wire Connectors—Wiring Products (pp. 1–61).
Underwriters Laboratories, Inc. Standard—Standard for Safety—UL 486B (pp. 1–54 and sr1).

* cited by examiner

*Primary Examiner*—Paula Bradley
*Assistant Examiner*—Edwin A. Levin
(74) *Attorney, Agent, or Firm*—Wood, Herron & Evans, L.L.P.

(57) ABSTRACT

An electrical connector is disclosed having enhanced pull-out resistance for a stranded conductor secured therein. The metal body of the electrical connector includes a conductor-receiving bore for receiving the stranded conductor and a threaded bore for receiving a binding screw that orthogonally intersects the conductor-receiving bore. One or more opposed side walls of the metal body further includes at least one slot that is adapted to receive strands of the conductor displaced therein by a binding force applied by the conical tip of the binding screw.

24 Claims, 3 Drawing Sheets

SLOTTED ELECTRICAL CONNECTOR

FIELD OF THE INVENTION

The present invention relates to electrical connectors and, in particular, to electrical connectors with an improved conductor holding ability for securing a stranded electrical conductor.

Background

Electrical connectors are commonly used to terminate an electrical conductor for the purpose of connecting the connector to an electrical device or to a different electrical conductor. A conventional electrical connector generally comprises a solid electrically-conductive metal body adapted to contact the conductor, a clamping mechanism that secures a surface of the conductor against a surface of the connector body, and means for connecting the connector to another conductor or electrical device. The ability of the electrical connector to resist disconnection of the conductor, such as pull-out of the end of a stranded conductor from within a connector-receiving bore provided in the connector body is proportional to the magnitude of the binding force applied by the clamping mechanism to the conductor.

One known type of electrical connector comprises a metal body having a cylindrical conductor-receiving bore oriented perpendicular to a threaded bore that receives a binding screw. The tip of the binding screw impales and compressively engages the end of the conductor inserted in the conductor-receiving bore to complete the electrical and mechanical connection between the connector and the conductor.

Electrical connectors will typically be rated with a recommended binding screw installation torque for a specific application and conductor size. A stranded conductor comprises a plurality of individual strands of a metal, usually aluminum or copper. Strands are arranged as a bundle in generally concentric, annular layers. The bundle of annular layers may be compacted to reduce or substantially eliminate the empty spaces (i.e., interstices) between adjoining strands.

Electrical connectors have been proposed with purportedly improved conductor-holding ability for stranded conductors. For example, the electrical connector shown in U.S. Pat. No. 4,146,290 (Annas et al.) incorporates a single, small, off-center circular window formed into the lower portion of one or more side walls thereof. A binding force is applied by tightening a binding screw received in a threaded bore in an upper wall. If the magnitude of the binding force is sufficiently large, the bottom portion of the conductor within the conductor-receiving bore may deform laterally and partially occupy the opening defined by each circular window.

Conventional electrical connectors of the foregoing type fail to consistently achieve satisfactory conductor-holding ability and have only a limited resistance to pull-out when, for example, the conductor is subjected to enormous overcurrents, such as 200,000 amps. Even if a recommended installation torque is applied to the binding screw, the conventional electrical connector may not securely fasten the conductor for the range of operating conditions or for extraordinary events or environments, particularly overcurrents of the noted magnitude.

The industry has proposed certification standards that require the electrical connector to attain specific mechanical and electrical specifications under various operating environments. Many conventional electrical connectors fail to consistently achieve the mechanical and electrical specifications under these standards. Under certain circumstances, the electrical connector may mechanically fail under a recommended installation torque that complies with a certification standard.

Thus, what is ideally desired is an electrical connector for use with a stranded conductor that tolerates large binding forces and exhibits enhanced conductor-holding ability and superior resistance to conductor pull-out when subjected to large instantaneous overcurrents.

SUMMARY OF THE INVENTION

The present invention addresses these and other problems associated with the prior art by defining an electrical connector having significantly improved mechanical holding properties. In accordance with the principles of the present invention and according to the described embodiments, the present invention is directed to an electrical connector with one or more integral structures designed to promote the improved mechanical holding ability. An electrical connector having features of the present invention comprises an electrically-conductive metal body having a conductor-receiving bore, a threaded screw-receiving bore that accommodates a binding screw having a particularized structure, and structure incorporated into the walls of the connector body that supplements the binding forces imparted by the binding screw.

In one aspect of the present invention, the connector wall structure comprises one or more slots, preferably non-circular, that are strategically positioned in opposed side walls of the connector body and communicate with both of the conductor-receiving and screw-receiving bores. When a sufficient compressive force is applied by the binding screw to deform and displace strands of a stranded conductor received within the conductor-receiving bore, each slot receives one or more strands of the conductor which are outwardly deflected. Each slot is substantially centered and substantially symmetrical with respect to the longitudinal axis of the binding screw and preferably substantially identically configured. Further, the major axis of each slot is substantially parallel to the axis of the screw-receiving bore and has a length approximately equal to the major dimension of the conductor-receiving bore measured parallel to the axis of the screw-receiving bore. In a preferred embodiment, the slots have an oval cross-sectional profile comprising a semicircular top portion, a substantially rectangular middle portion, and a semicircular bottom portion. However, the slots may have other cross-sectional profiles or serrations.

In another aspect of the present invention, the wire binding screw has a conical tip that is adapted to preferentially deflect strands of the conductor thereabout. The conical tip preferably has a blunt extremity formed with a small radius that can penetrate between and separate strands of the conductor when urged thereagainst. The conical tip has an included angle $\phi$ chosen so that strands will preferentially slide along the inclined surface thereof, forcing some strands to occupy the opening defined by each slot. These displaced strands will extend outwardly of the normal circumference of the stranded conductor and protrude into the slot beyond the diameter of the conductor-receiving bore.

The present invention has an advantage in that a conductor clamped in the conductor-receiving bore is more resistant to pull-out than heretofore believed possible. The significant displacement of the strands into the appreciably sized slots provides significant mechanical anchoring unachieved by conventional electrical connectors.

The present invention has a further advantage that the current-carrying capability of the connection is enhanced. The slots have sharp edges that scrape oxidation from surfaces of the outer strands to enhance the electrical contact between the conductor and body of the electrical connector.

The present invention has a yet further advantage that the overall design of the connector body enhances the torque that can be applied to the binding screw. As a result, a larger binding force may be applied by the tip of the binding screw to the surface of the conductor, enhancing pull-out resistance of the conductor relative to the connector.

These and other objects, advantages, features, and embodiments will be apparent with reference to the following drawings and detailed written description.

BRIEF DESCRIPTION OF THE DRAWINGS

FIGS. 1–3 show a first embodiment of an electrical connector incorporating features according to the present invention. Referring to FIG. 1, electrical connector 15 includes a rigid metal body 20, an elongate metal tang 22, and a binding screw 24. Metal body 20 defines a top surface 26, a bottom surface 28, and opposed side walls 30, 30' that are continuous with the top and bottom surfaces 26, 28. Metal body 20 includes a conductor-receiving bore 32 extending longitudinally therethrough for receiving one end of a stranded conductor 34 (shown in FIGS. 2 and 3). Stranded conductor 34 comprises a compacted bundle of individual strands of an electrically-conductive material, such as copper or aluminum. Conductor-receiving bore 32 is generally cylindrical and has a circular cross-section of a radial dimension adequate to receive stranded conductor 34 therein. Conductor-receiving bore 32 is disposed substantially orthogonally to the planes defined by sidewalls 30, 30'. In a preferred embodiment, metal body 20 has a substantially rectangular cross-sectional profile.

Figure 1:
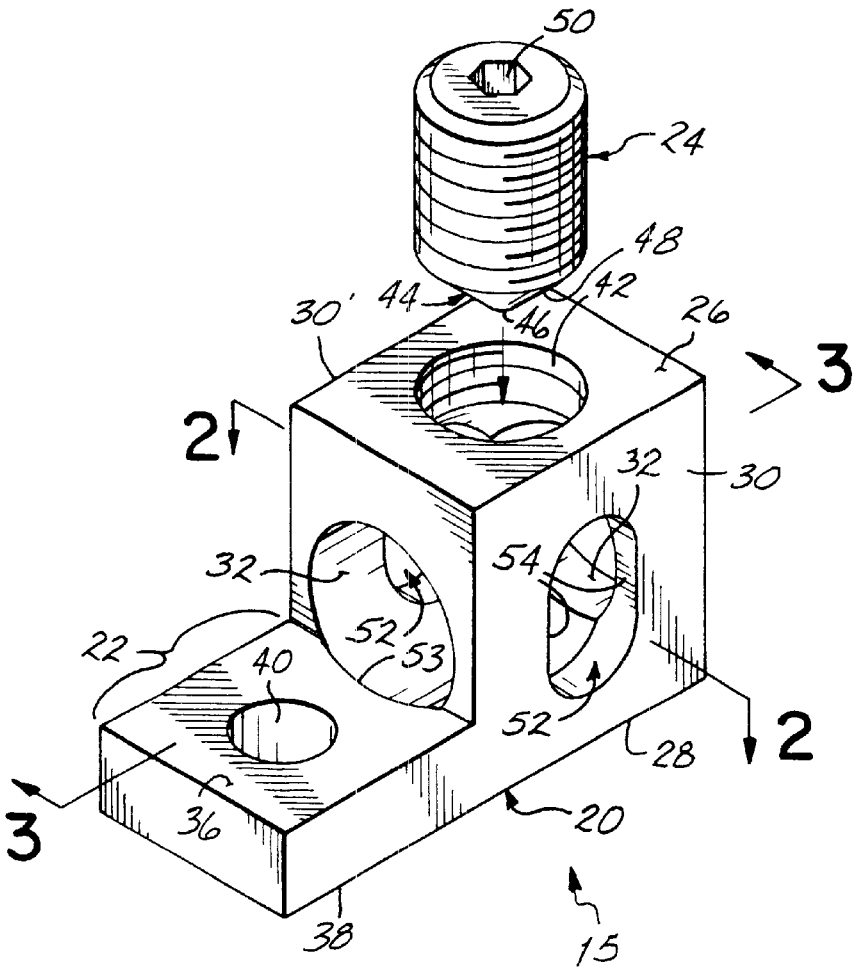
FIG. 1 is a disassembled perspective view of a preferred embodiment of the electrical connector according to the present invention.

Metal tang 22 is an elongate member formed integrally with a longitudinal side of bottom surface 28. Metal tang 22 extends away from metal body 20 generally parallel to the longitudinal axis of conductor-receiving bore 32. In a preferred embodiment, metal tang 22 has parallel, flat opposed surfaces 36, 38 and a substantially rectangular cross-sectional profile. The bottom opposed surface 38 of metal tang 22 includes a seating surface that is adapted to engage a mounting surface (not shown) carried by an electrical device. Metal tang 22 further includes a mounting aperture 40 adapted to receive a fastener (not shown) for mechanically and electrically attaching electrical connector 15 to the mounting surface.

A threaded bore 42 extends downwardly through top surface 26 of metal body 20 and communicates with the interior of conductor-receiving bore 32. The longitudinal axis of threaded bore 42 is disposed substantially orthogonal to the longitudinal axis of conductor-receiving bore 32. Threaded bore 42 includes a continuous helical thread disposed along a substantial portion of the interior surface thereof.

Figure 3:
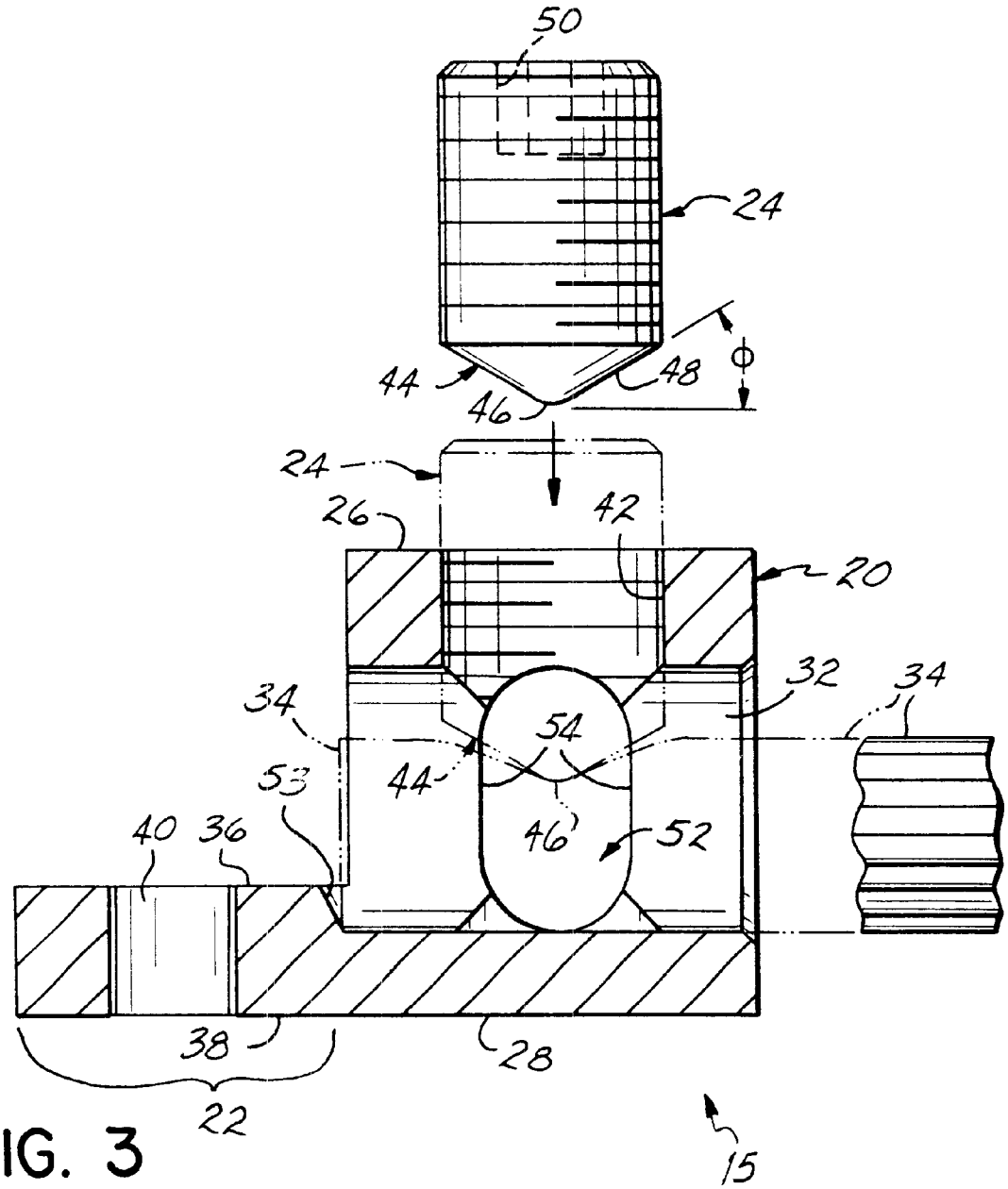
FIG. 3 is a side cross-sectional view of the electrical connector of FIG. 1, again shown with a stranded conductor inserted and the binding screw compressively engaged.

Binding screw 24 is removably received within threaded bore 42. In one aspect of the first embodiment, as best shown in FIG. 3, binding screw 24 includes a generally conical tip 44 having a slightly blunted extremity 46 of a small radius of curvature and an inclined surface 48. Inclined surface 48 is inclined at an angle $\phi$, relative to the plane tangent to blunted extremity 46, so that the contacting strands of the stranded conductor 34 will be induced to slidably deflect therealong. In addition, conical tip 44 encourages strands to rub together and remove oxidation from the surfaces thereof so that the quality of the electrical connection is improved. Preferably, the radius of the blunted extremity b46 is about 3⁄32inches and the inclined surface 48 is inclined at an angle $\phi$ of about 30°.

To facilitate insertion into threaded bore 42 and subsequent tightening, binding screw 24 has a shaped recess 50 for receiving a correspondingly shaped tool (not shown). Preferably, recess 50 and the tool removably receivable therein have a hexagonal cross-sectional profile, commonly known as hex-type or Allen-type. Other configurations of binding screw 24 are possible, such as a binding screw having a slotted head or Phillips-type head which can be tightened with an ordinary screwdriver.

Referring to FIG. 1, one or both opposed side walls 30, 30' of metal body 20 include at least one slot 52 therein. Each slot 52 defines a passageway that intersects and communicates with conductor-receiving bore 32. Preferably, each opposed side wall 30, 30' includes one slot 52 that is substantially centered horizontally with respect to the longitudinal axis of the conductor-receiving bore 32 and is also substantially centered vertically with respect to the longitudinal axis of the threaded bore 42. The major axis of slot 52 is substantially equal to a dimension of conductor-receiving bore 32. In the preferred embodiment, each slot 52 has a substantially oval cross-sectional profile with a semicircular top portion, a substantially rectangular middle portion, and a semicircular bottom portion. The major axis of slot 52 is preferably oriented orthogonal to the longitudinal axis of the conductor-receiving bore 32.

The metal body and the metal tang may be formed by extrusion or any other known method of metal fabrication. Preferably, the slots in the side walls are formed when the metal body is extruded so that a separate fabrication step is unnecessary. The electrical connector is preferably composed of an aluminum alloy. For the sake of compatibility during thermal cycling, the binding screw 24 and the electrical connector are preferably composed of similar aluminum alloys.

Figure 2:
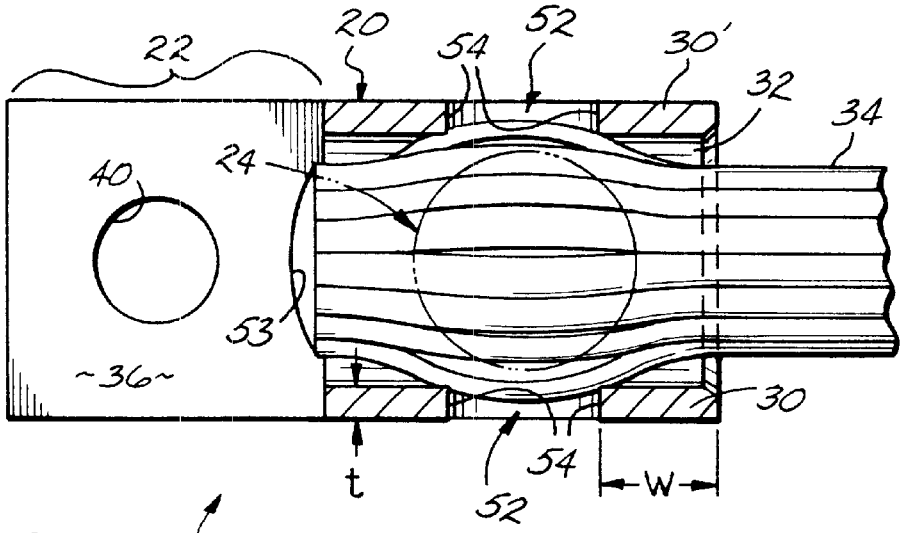
FIG. 2 is a partial cross-sectional view of the electrical connector of FIG. 1, shown with a stranded connector inserted and the binding screw compressively engaged.

FIGS. 2 and 3 illustrate the electrical connector of the present invention wherein the binding screw 24 has been advanced to compressively engage an upper peripheral surface of stranded conductor 34 and transmit a downward binding force thereto. To make a connection, an end of stranded conductor 34 is first inserted parallel to the longitudinal axis of the conductor-receiving bore 32. A lip 53 will abut the leading end of the stranded conductor and act as a stop to limit the insertion depth. If the end of the stranded conductor 34 is insulated, the sheathing (not shown) is stripped before insertion. Binding screw 24 is threadingly received by threaded bore 42 and the corresponding tool is used to apply a torque that turns binding screw 24 in an appropriate sense.

When helically advanced in the appropriate rotational sense, binding screw 24 moves downward towards the bottom surface 28 of metal body 20 and engages the upper peripheral surface of stranded conductor 34. As the applied torque is increased, a lower peripheral surface of stranded conductor 34 will be forced downward against the interior bottom and side surfaces of conductor-receiving bore 32. Due to the restraint, continued application of torque will cause the slightly blunted extremity 46 of binding screw 24 to spread and displace a pair of strands near the point of contact with the upper peripheral surface of stranded conductor 34.

The initial pair of strands will respond to the downward, compressive force, imparted by the tip 44 of binding screw 24 by elastically and plastically deforming. The strands will deform both transverse and parallel to the direction of the compressive force. However, due to the conical tip 44 present on binding screw 24, the initial pair of strands will also slidably translate in opposed directions along inclined surface 48 away from blunted extremity 46. As the binding screw 24 is further advanced, strands in the outer layer of the stranded conductor 34 will contact the inclined surface 48 and likewise experience deformation and outward deflection. Strands that are not in direct contact with the conical tip of the binding screw 24 will also be deformed and deflected transversely as the binding screw advances downwardly. These strands will react to the forces transmitted by abutting strands more proximate to the conical tip 44 of the binding screw 24. Of course, the lateral deflection and deformation will be proportioned to the distance from the point of contact and symmetrical about the blunted extremity 46 of the conical tip 44. The deflection may also have a rotational component that will rotate the strands about the longitudinal axis of the stranded conductor 34 relative to their placement in an uncompressed state in the bundle.

Strands in the outer layer of the stranded conductor 34 will abut and be coextensive with the opposed side surfaces of conductor-receiving bore 32. Because the strands are composed of a ductile metal, some of the deflected strands will plastically and elastically deform relative to the points of contact with the periphery of each slot 52 and partially protrude into the interior of the opening defined by each slot 52. Because the longitudinal-axis of the binding screw 24 is parallel to the major axis of the s protrusion will be centered thereabout. Against the mechanical resistence provided by the stranded conductor 34, a predetermined installation torque is applied to binding screw 24.

Because the strands protrude beyond the cylindrical wall defined by the interior of conductor-receiving bore 32, the conductor holding ability of the electrical connector 1 5 is enhanced over an equivalent electrical connector lacking one or more slots similar to slot 52. As a result, stranded conductor 34 is more resistant to pull-out compelled by a linear force applied parallel to the longitudinal axis thereof. Due to the enhanced mechanical holding ability, electrical connector 15 is also less susceptible to mechanical vibrations or temperature changes during operation.

Under the static force applied by the installation torque, opposed side walls 30, 30' of the metal body 20 will be under tension. Specifically, top surface 26 will be induced to separate from bottom surface 28 under the opposite and equal upward force experienced by metal body 20 that balances the downward force applied by the binding screw 24 to stranded conductor 34. However, the structural integrity and structural rigidity of the side walls 30, 30' prevent mechanical failure from occurring. To maintain a sufficient rigidity, the dimensions and positioning of slots 52 and conductor-receiving bore 32 are selectively engineered so that the opposed side walls 30, 30' are sufficient in dimension to withstand the opposed acting forces.

If electrical connector 15 is fabricated from a medium to high strength aluminum alloy, such as 6061-T6 aluminum, the metal body has a width of about 1.300 inches, a length of about 1.660 inches, and a height of about 1.820 inches, and the conductor-receiving bore has a diameter of about 1.045 inches, each oval slot preferably will have a major axis of about 1.045 inches, a minor axis of about 0.625 inches, and a radius of curvature of about 0.312 inches with respect to a vertex positioned about 0.210 inches from the centerline of the slot. As an attribute of a structure having such dimensions, and with reference to FIG. 1, the side walls will have a thickness t of about 0.127 inches and a width w of about 0.520 inches. Dimensions such as these provide a compact electrical connector with sufficient structural rigidity and bulk to withstand the binding force applied to the stranded conductor and to securely fasten the stranded conductor within the interior of the conductor-receiving bore.

Electrical connectors must obtain regulatory approval certifying that the connector will perform reliably for use in specific applications. For example, the electrical connector of the present invention is preferably constructed in accordance with both a.) Underwrities Laboratories (UL) standards, permitting use of the invention in the United States and b.) Canadian Standards Association (CSA) standards permitting the invention to be used in Canada. The present invention, bearing llsco catalog number D3591, has been qualified for pull-out resistance and conductor secureness requirements under UL Standard 486B for use with either a non-compacted copper conductor or a compacted aluminum conductor. In addition, llsco connector D3591 has qualified under CSA standard C 22.2 M65-93 for use with a compacted copper conductor. The recommended installation torque for the D3591 electrical connector is about 620 inch pounds. The llsco D3591 connector, or any connector constructed according to the present invention, can withstand such a large installation torque due to the features of the present invention.

It may also be appreciated that the sharp edge 54 about the inner diameter of the periphery of each slot 52 will remove metallic oxidation from the peripheral surfaces of the strands that protrude therein. As the strands enter the slots, their peripheral surfaces scrape against the sharp edge 54. Since the otherwise electrically-insulating oxidation is removed, the quality of the electrical contact between the metal body 20 and the stranded conductor 34 will be improved. In alternative embodiments, the surface defined by the inner diameter of slot 52 may be beveled or include a plurality of serrations disposed thereabout.

FIGS. 4A–G show alternative embodiments of the electrical connector in which only the geometrical shape of the slot has been altered. For any given geometrical shape of the slot, the metal body must retain sufficient structural rigidity to withstand the recommended installation torque without experiencing a mechanical failure. Certain geometric shapes, such as slots having a circular cross-sectional profile, cannot withstand the enhanced applied torques unless the dimensions of the side walls of the metal body are enhanced.

Figure 4A:
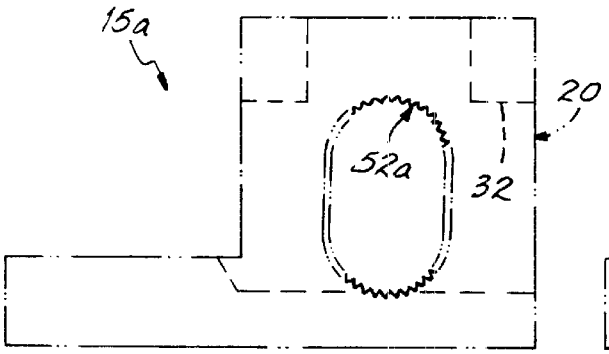
FIGS. 4A–4H are side elevational views of alternative embodiments of the electrical connector of the present invention.

FIG. 4A shows an electrical connector 15*a* having a notched edge comprising a plurality of serrations superimposed on, and disposed about, the periphery of the prolate oval slot 52*a,* similar to the slot illustrated in FIGS. 1–3. Serrations may or may not extend completely about the periphery and may be disposed with a regular separation distance or randomly. Serrations are expected to enmesh with the displaced strands, received within the slot, to further augment the conductor holding ability of the electrical connector.

Figure 4B:
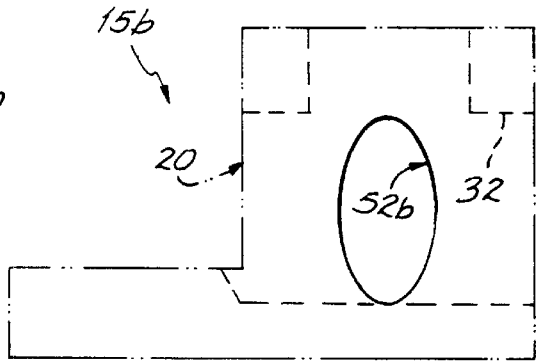
Figure 4C:
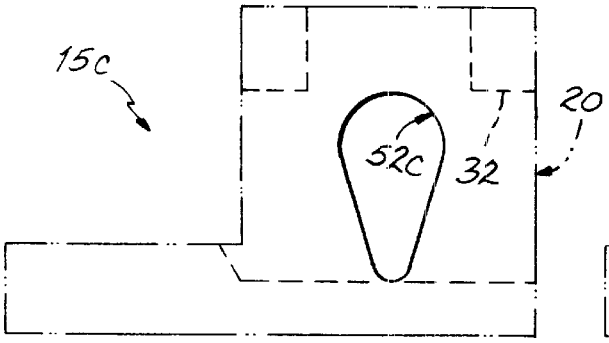
Figure 4D:
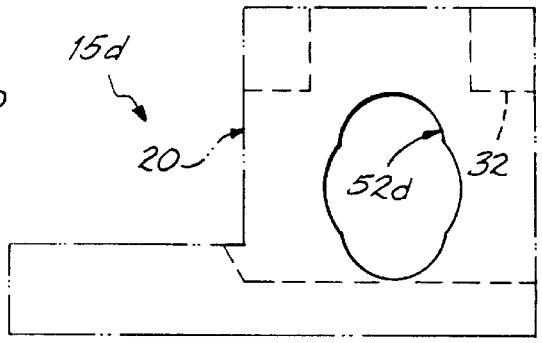
Figure 4E:
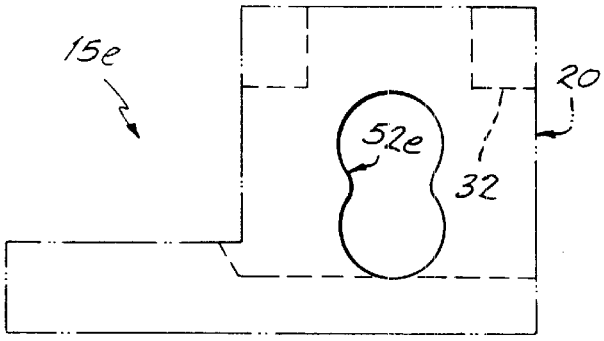
Figure 4F:
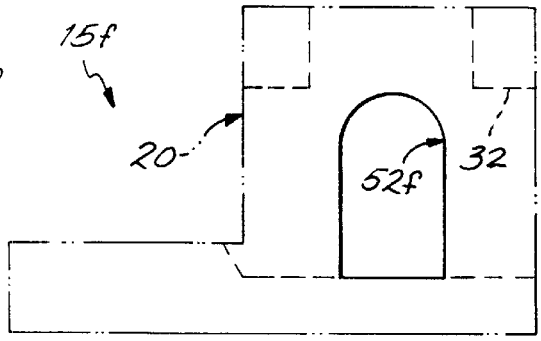
Figure 4G:
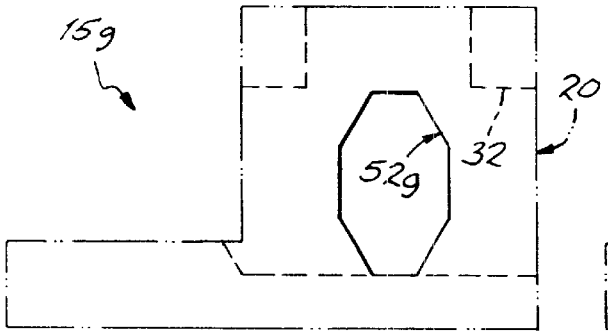
Figure 4H:
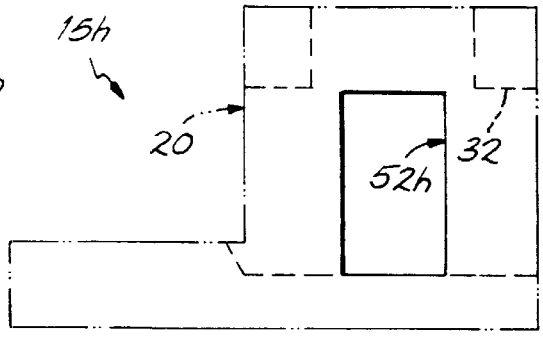

FIG. 4B displays an electrical connector 15*b* having an elliptical slot 52*b* with a vertical major axis. FIG. 4C depicts an electrical connector 15*c* having a tapered slot 52*c* with the shape of a keyhole. Geometrical shapes are not limited to having vertical sides parallel to the longitudinal axis of the threaded bore. FIG. 4D illustrates an electrical connector 15*d* having an oval slot 52*d* with a mesial portion of increased diameter. FIG. 4E shows an electrical connector 15*e* having an oval slot 52*e* with a mesial portion of a reduced diameter. FIG. 4F displays an electrical connector 15*f* having an arch-shaped slot 52*f* with a rounded top and a flat bottom. FIG. 4G depicts an electrical connector 15*g* having an octagonal slot 52*g*. FIG. 4H illustrates an electrical connector 15*h* having a rectangular slot 52*h* with a vertical longitudinal axis. Any of the embodiments in FIGS. 4B–4H may have serrations superimposed on the surface of the periphery of the slot.

The geometrical shapes depicted in FIGS. 4A–H are merely illustrative and are not intended to be exhaustive of the potential range of geometrical shapes or dimensions thereof. Other shapes and dimensions for the slots would be apparent to one of ordinary skill in the art of electrical connectors. However, in accordance with the present invention, such shapes and dimensions are restricted such that each slot is substantially centered with respect to both the longitudinal axis of the conductor-receiving bore and the longitudinal axis of the threaded bore, and has a vertical dimension substantially equal to the radial dimension of the cylindrical conductor-receiving bore. Additionally, the ratio of the major axis to the minor axis of the slots is preferably in the range of 1.2–2.0 with the most preferred ratio being approximately 1.7.

The previously described versions of electrical connector according to the present invention have many advantages, including an enhanced mechanical holding ability, an enhanced current-carrying ability, an enhanced mechanical resistance to conductor pull-out, and a construction that enhances the torque that may be applied to the binding screw. The deflection of strands into the slots, facilitated by the conical shape of the tip of the binding screw and the permissively enhanced torque, results in a reduced contact resistance and anchors the stranded conductor to meet certified conductor secureness and pull-out requirements.

While the present invention has been illustrated by a description of various embodiments and while these embodiments have been described in considerable detail, the applicants do not intend to restrict, or in any way limit, the scope of the appended claims to such detail. Additional advantages and modifications will readily appear to those skilled in the art. The invention in its broader aspects is therefore not limited to the specific details and representative apparatus shown and described. Accordingly, departures may be made from such details without departing from the spirit or scope of applicant's general inventive concept.

What is claimed is:

1. An electrical connector for receiving an end section of a stranded conductor, said electrical connector comprising:

a connector body having a top wall, a bottom wall, opposed side walls, and a conductor-receiving bore, the conductor-receiving bore having a longitudinal axis and a bottom contact surface that is free of recesses, the conductor-receiving bore being aligned substantially parallel with respect to the side walls, a tang formed integrally with said connector body, said tang adapted for connection to a mounting surface, a single threaded bore extending downwardly through the top wall of said connector body, said threaded bore having a longitudinal axis, communicating with the conductor-receiving bore, and being disposed substantially orthogonal with respect to the conductor-receiving bore, a single binding screw threadingly received within said threaded bore, said binding screw having a conical tip facing the bottom contact surface of the conductor-receiving bore and positioned to compressively engage an end section of a stranded conductor located in the conductor-receiving bore between the bottom contact surface and the conical tip, the conical tip operable as said binding screw is advanced toward the bottom contact surface to deflect strands of the stranded conductor laterally outward away from the tip in opposite directions substantially perpendicular to the direction of advancement of said binding screw and generally toward each of the side walls, and a non-circular slot extending through each of the side walls of said connector body and communicating with the conductor-receiving bore, each of said slots substantially centered with respect to the longitudinal axis of said conductor-receiving bore and substantially centered with respect to the longitudinal axis of the threaded bore, each of said slots surrounded by an inner peripheral edge extending no lower than the bottom contact surface of the conductor-receiving bore, wherein plural strands of the stranded conductor deflected laterally by the conical tip of said binding screw protrude into each of said slots and engage the inner peripheral edge at plural points of contact so as to enhance the resistance of the stranded conductor within the conductor-receiving bore to a pull-out force applied to the stranded conductor in a direction tending to remove the end section of the stranded conductor from the conductor-receiving bore.

2. The electrical connector of claim 1, wherein said tang extends outwardly from the bottom wall of said connector body in a direction generally parallel to the longitudinal axis of symmetry of the conductor-receiving bore.

3. The electrical connector of claim 1, wherein each of said slots has a major axis that is oriented parallel to the longitudinal axis of said threaded bore.

4. The electrical connector of claim 1, wherein each of said slots has a cross-sectional profile viewed in a direction perpendicular to the side walls selected from the group consisting of elliptical, rectangular, rhomboidal, trapezoidal, polygonal, arch-shaped, keyhole, and combinations thereof.

5. The electrical connector of claim 1, wherein said slots have substantially dissimilar cross-sectional profiles viewed in a direction perpendicular to the side walls.

6. The electrical connector of claim 1, wherein each of said slots has an interior surface which includes a plurality of serrations.

7. The electrical connector of claim 3, wherein the longitudinal axis of said conductor-receiving bore intersects the longitudinal axis of said threaded bore.

8. The electrical connector of claim 1, wherein said slots are substantially identically configured and substantially identically oriented relative to said threaded bore and the conductor-receiving bore.

9. The electrical connector of claim 1, wherein said connector body has a substantially rectangular cross-sectional profile when viewed orthogonally to the longitudinal axis of said threaded bore and when viewed orthogonally to the lonitudinal axis of the conductor-receiving bore.

10. The electrical connector of claim 1, wherein each of said slots is a substantially elliptical slot with a cross-sectional profile viewed in a direction perpendicular to the side walls characterized by a semi-circular top portion, a substantially rectangular middle portion, and a semi-circular bottom portion.

11. The electrical connector of claim 10, wherein the length of the major axis of each of said slots is at least about 1.2 to 2.0 times the length of the minor axis.

12. The electrical connector of claim 1, wherein the conical tip of said binding screw has a slightly blunted extremity.

13. The electrical connector of claim 12, wherein the conical tip has an included angle no larger than about 30 degrees and the slightly blunted extremity has a radius of curvature of about 3⁄32 inch.

14. The electrical connector of claim 1, wherein a predetermined installation torque is applied to said binding screw such that said electrical connector meets or exceeds the requirements of Underwriters Laboratories Standard 486B.

15. The electrical connector of claim 14, wherein said predetermined installation torque is about 620 inch pounds.

16. The electrical connector of claim 14, wherein said electrical connector further meets or exceeds the requirements of Canadian Standards Association Standard C 22.2 M65-93.

17. The electrical connector of claim 1, wherein a predetermined installation torque is applied to said binding screw such that said electrical connector meets or exceeds the requirements of Canadian Standards Association Standard C 22.2 M65-93.

18. The electrical connector of claim 17, wherein said predetermined installation torque is about 620 inch pounds.

19. A method for connecting the end section of a stranded conductor to an electrical connector to provide improved pull-out resistance, said method comprising:

providing an electrical connector including:

a body having a top wall, a bottom wall, opposed side walls, and a conductor-receiving bore, the conductor-receiving bore having a longitudinal axis and a bottom contact surface that is free of recesses, the conductor-receiving bore being aligned substantially parallel with respect to the side walls;

a tang formed integrally with said connector body, said tang adapted for connection to a mounting surface;

a single threaded bore extending downwardly through the top wall of said connector body, said threaded bore having a longitudinal axis, communicating with the conductor-receiving bore, and being disposed substantially orthogonal with respect to the conductor-receiving bore;

a single binding screw threadingly received within said threaded bore, said binding screw having a conical tip facing the bottom contact surface of the conductor-receiving bore and positioned to compressively engage an end section of a stranded conductor located in the conductor-receiving bore between the bottom contact surface and the conical tip, the conical tip operable as said binding screw is advanced toward the bottom contact surface to deflect strands of the stranded conductor laterally outward away from the tip in opposite directions substantially perpendicular to the direction of advancement of said binding screw and generally toward each of the side walls; and a non-circular slot extending through each of the side walls of said connector body and communicating with the conductor-receiving bore, each of said slots substantially centered with respect to the longitudinal axis of said conductor-receiving bore and substantially centered with respect to the longitudinal axis of the threaded bore, each of said slots surrounded by an inner peripheral edge extending no lower than the bottom contact surface of the conductor-receiving bore;

inserting an end section of a stranded conductor into the conductor-receiving bore to place a surface portion of the end section between the conical tip of the binding screw and the bottom contact surface; and compressively engaging the end section of the stranded conductor between the conical tip of the binding screw and the bottom contact surface so that plural strands of the stranded conductor are deflected laterally outward by the conical tip of the binding screw in opposite directions substantially perpendicular to the direction of advancement of the binding screw and generally toward each of the side walls to protrude into each of the slots, the plural strands engaging the inner peripheral edge at plural points of contact so as to enhance the resistance of the stranded conductor within the conductor-receiving bore to a pull-out force applied to the stranded conductor in a direction tending to remove the end section of the stranded conductor from the conductor-receiving bore.

20. The method of claim 19, wherein a predetermined installation torque is applied to the binding screw such that said electrical connector meets or exceeds the requirements of Underwriters Laboratories Standard 486B.

21. The method of claim 20, wherein said electrical connector further meets or exceeds the requirements of Canadian Standards Association Standard C 22.2 M65-93.

22. The method of claim 20, wherein said predetermined installation torque is about 620 inch pounds.

23. The method of claim 19, wherein a predetermined installation torque is applied to the binding screw such that said electrical connector meets or exceeds the requirements of Canadian Standards Association Standard C 22.2 M65-93.

24. The method of claim 23, wherein said predetermined installation torque is about 620 inch pounds.

* * * * *

UNITED STATES PATENT AND TRADEMARK OFFICE

CERTIFICATE OF CORRECTION

PATENT NO. : 6,338,658 B1
DATED : January 15, 2002
INVENTOR(S) : Thomas M. Sweeney It is certified that error appears in the above-identified patent and that said Letters Patent is hereby corrected as shown below:

Column 3,
Line 30, header line "Description" is missing.

Column 4,
Line 15, reads "b46" and should read -- 46 --.
Line 50, reads "connector are probably" and should read -- connector 15 are probably --.

Column 5,
Line 21, reads "conical tip of" and should read -- conical tip 44 of --.
Line 40, reads "the longitudinal-axis of the binding screw 24 is parallel to the major axis of the s protrusion" and should read -- the longitudinal axis of the binding screw 24 is parallel to the major axis of the slot 52, the protrusion --.

Column 6,
Line 23, reads "Underwrities" and should read -- Underwriters --.
Lines 26, 31 and 35, read "llsco" and should read -- Ilsco --.

Column 8,
Line 56, reads "of claim 3, wherein the longitudinal axis of said conductor" and should read -- of claim 1, wherein the longitudinal axis of the conductor --.

Column 9,
Lines 7-9, read "of claim 10, wherein the length of the major axis of each of said slots is at least about 1.2 to 2.0 times the length of the minor axis." and should read -- of claim 3, wherein the length of the major axis of each of said slots is at least about 1.2 to 2.0 times the length of a minor axis thereof. --.

Signed and Sealed this

Eighth Day of October, 2002

*Attest:*

*Attesting Officer*

JAMES E. ROGAN
*Director of the United States Patent and Trademark Office*